US010624169B1

(12) United States Patent
Zhuang

(10) Patent No.: US 10,624,169 B1
(45) Date of Patent: Apr. 14, 2020

(54) LED CURRENT RIPPLE ELIMINATION CIRCUIT APPLICABLE TO VERY LOW TRIAC DIMMING DEPTH

(71) Applicant: DIOO MICROCIRCUITS CO., LTD, Nantong, JiangSu Province (CN)

(72) Inventor: Hualong Zhuang, Nantong (CN)

(73) Assignee: DIOO MICROCIRCUITS CO., LTD, Jiangsu Province (CN)

( * ) Notice: Subject to any disclaimer, the term of this patent is extended or adjusted under 35 U.S.C. 154(b) by 0 days.

(21) Appl. No.: 16/240,329

(22) Filed: Jan. 4, 2019

(30) Foreign Application Priority Data

Sep. 28, 2018 (CN) ..... 2018 1 11354120

(51) Int. Cl.
*H05B 33/08* (2020.01)

(52) U.S. Cl.
CPC ..... *H05B 33/0845* (2013.01); *H05B 33/0815* (2013.01)

(58) Field of Classification Search
CPC ..... H05B 33/0845; H05B 33/0815; H05B 33/0857
See application file for complete search history.

(56) References Cited

U.S. PATENT DOCUMENTS 10,390,393 B2 * 8/2019 Huang ..... G05F 1/56
2012/0133293 A1 * 5/2012 Shin ..... H05B 33/0815 315/200 R
2014/0176017 A1 * 6/2014 Kuang ..... H05B 33/0824 315/307
2015/0381054 A1 * 12/2015 Chang ..... H02M 3/33507 315/294
2016/0065051 A1 * 3/2016 Kuang ..... H02M 1/14 315/186
2017/0181234 A1 * 6/2017 Huang ..... G05F 1/56
2018/0026521 A1 * 1/2018 Huang ..... G05F 1/56 363/39
2018/0324913 A1 * 11/2018 Deng ..... H02M 1/15

FOREIGN PATENT DOCUMENTS

CN 208424843 U * 1/2019 ..... H05B 33/08

* cited by examiner

*Primary Examiner* — Raymond R Chai
(74) *Attorney, Agent, or Firm* — Muncy, Geissler, Olds & Lowe, P.C.

(57) ABSTRACT

A driver circuit for eliminating current ripple of an LED driver system comprises a current ripple control module, a low loop response module, an LEDN potential detection response module, a start fast response module and a dimming fast response module, and the driver circuit has a very low system loop response speed in a stable operating state, thus ensuring excellent output current ripple elimination function of the circuit and eliminating breathing type sway of an LED lamp at a very low frequency due to a low TRIAC dimming current.

9 Claims, 9 Drawing Sheets

LED CURRENT RIPPLE ELIMINATION CIRCUIT APPLICABLE TO VERY LOW TRIAC DIMMING DEPTH

FIELD OF THE INVENTION

The invention relates to a driver circuit used for eliminating current ripple of a light emitting diode (LED) driver system, in particular to an LED current ripple elimination circuit applicable to very low triode AC switch (TRIAC) dimming depth.

DESCRIPTION OF THE RELATED ART

LED light sources are characterized by low power consumption, light weight and constant current drive. In the prior art, generally constant current output is used to drive an LED load, and high power factor is also required. As a large electrolytic condenser is not present behind a bridge rectifier, low-frequency ripple noise resulting from sinusoidal wave of an AC network is transmitted to the output end, resulting in flickering (stroboflash) of LED lamps. For example, if frequency of an input source is 50 Hz, the current output by a constant current driver means contains 100 Hz ripple, and correspondingly voltage of a filter capacitor also contains 100 Hz ripple. Meanwhile, the current flowing through the LED load also contains 100 Hz ripple, causing the light output by the LED load to contain 100 Hz stroboflash. Although such low-frequency stroboflash is hard to be perceived by human eyes, exposure of human eyes to such lighting environment will result in fatigue of the optic nerve, impairing human health.

FIG. 1 shows a structure diagram of functional means of a typical LED driver system. In the prior art, in order to ensure that a power MOS transistor M1 works in a saturation region, the transistor M1 is required to be connected with a large energy storage capacitor C1. With an increase in capacitance value of the energy storage capacitor C1, the cost thereof is relatively high, and the volume thereof also increases significantly. However, a large-volume energy storage capacitor C1 usually can not meet the requirements of novel LED lamps for volume of a driver PCB.

Meanwhile, the prior art can not adapt to all commercially available TRIAC dimmers. When a TRIAC dimmer of the prior art is dimmed to below 5% depth, the matching LED lamps always suffer from low-frequency breathing type sway.

SUMMARY OF THE INVENTION

To this end, the object of the invention is to provide an LED current ripple elimination circuit for suppressing the working frequency ripple of an LED driver and eliminating the breathing sway of LED lamps due to a low TRIAC dimming current resulting from the fluctuating effective value of input AC power supply, and the invention meets the requirements for system cost, efficiency and versatility to the great extent.

The invention is realized as follows: a driver circuit for eliminating the current ripple of an LED driver system, constructed on the LED driver system, the LED driver system comprising an LED load, an MOS transistor and a constant current control circuit, the LED load being connected between a drain electrode of the MOS transistor and the constant current control circuit, a source electrode of the MOS transistor being grounded and connected to the constant current control circuit, one end of a capacitor being connected with the constant current control circuit, and the source electrode of the MOS transistor being grounded (GND) through a resistor, and characterized in that the driver circuit comprises a current ripple control means, a low loop response means, an LEDN potential detection response means, a start fast response means and a dimming fast response means.

The current ripple control means is connected with a gate electrode of the MOS transistor, the source electrode of the MOS transistor, a low loop response means, an LEDN potential detection response means, a start fast response means and a dimming fast response means respectively, and connected to another end (VC end) of the capacitor, and used for adjusting a gate-source voltage of the MOS transistor, thus further adjusting a conduction impedance of the MOS transistor to convert current ripple output by a preceding-stage constant current to voltage ripple at two ends of the drain electrode and the source electrode of the MOS transistor.

The low loop response means is connected with the potential detection response means and the another end (the VC end) of the capacitor respectively and grounded, and used for eliminating the breathing type sway of the LED load at a very low frequency due to a low TRIAC dimming current resulting from the fluctuating effective value of input AC power supply.

The LEDN potential detection response means is connected with the VC end of the capacitor, the drain electrode of the MOS transistor and one end (LEDN end) of the LED load respectively, and used for controlling the magnitude of current flowing to the VC end according to potential of the LEDN end.

The start fast response means is used for increasing the current flowing to the VC end while the preceding-stage output current is increasing (i.e. when the system is started or a TRIAC dimming conduction angle increases) to increase the response speed of the system.

The dimming fast response means is used for enabling a leakage path from the VC end to the ground when the TRIAC dimming conduction angle decreases to quickly decrease the gate-source voltage of the MOS transistor to adapt to low current flow.

In an embodiment of the invention, a system response period is at least higher than the fluctuation period of an effective value of voltage of the mains supply while the low loop response means is set to be in normal operation.

In an embodiment of the invention, the LEDN potential detection response means is made of at least one zener voltage stabilizing diode and a current limiting resistor connected in series between the gate electrode and the drain electrode of the MOS transistor; and preferably, a high voltage diode, a high voltage MOSFET or a high voltage bipolar junction transistor (BJT) is parallel connected between two ends of the series connected at least one zener voltage stabilizing diode.

In an embodiment of the invention, the LEDN potential detection response means is made of at least one bipolar junction transistor (BJT) and a current limiting resistor connected in series between the gate electrode and the drain electrode of the MOS transistor.

In an embodiment of the invention, the LEDN potential detection response means is series connected with at least one metal oxide semiconductor field effect transistor (MOSFET) with a gate and a source shorted together and a current limiting resistor between the gate electrode and the drain electrode of the MOS transistor.

In an embodiment of the invention, the VC capacitor discharges to the GND through the resistor between the gate electrode of the MOS transistor and the GND; and preferably, resistance of the resistor between the gate electrode of the MOS transistor and the GND is above 1 MΩ.

As before, the driver circuit used for eliminating the current ripple of a light emittig diode (LED) driver system according to the invention has a very low system loop response speed in a stable operating state, thus ensuring excellent output current ripple elimination function of the circuit and eliminating the breathing type sway of an LED lamp at a very low frequency due to a low TRIAC dimming current.

DESCRIPTION OF MARKS

Figure 1:
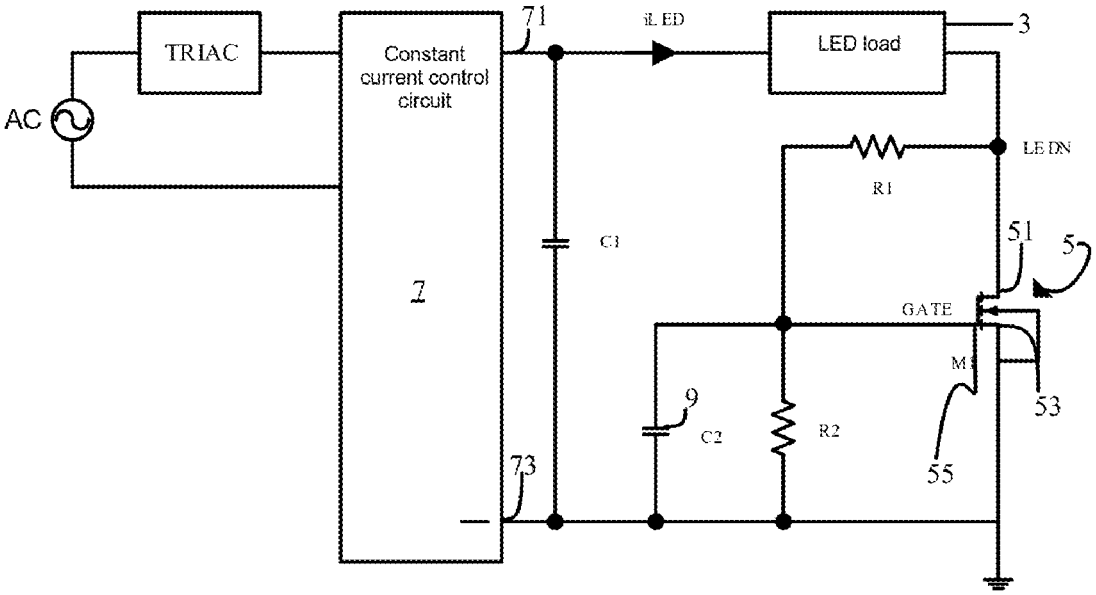
FIG.1 (prior art)
FIG. 1 shows a structure diagram of functional means of a typical LED driver system.

1 Driver circuit of the invention
11 Current ripple control means
13 Low loop response means
15 LEDN potential detection response means
17 Start fast response means
19 Dimming fast response means
3 LED load
5 MOS transistor
51 Drain electrode
53 Source electrode
55 Gate electrode
7 Constant current control circuit
71 Positive electrode
73 Negative electrode
8 Resistor
9 Capacitor
GND Ground
Z1 Voltage stabilizing diode

DESCRIPTION OF THE PREFERRED EMBODIMENTS

The specific structures and detailed functions disclosed herein are given as representatives only for describing exemplary embodiments of the invention. The invention may be embodied into various alternative forms, but the embodiments should not be construed as limited herein.

For description of the invention, it should be noted that the term "connection" should be understood in a board sense unless otherwise clearly specified and defined. For example, it may be a fixed connection, a removable connection or an integrated connection; and it can be direct connection or indirect connection through an intermediate, or it can be an overlap joint between two components. Those of ordinary skill in the art can understand the specific meaning of the term in the invention according to actual conditions.

The driver circuit according to the invention is constructed on an LED driver system shown in FIG. 1 (see FIG. 1), and the LED driver system comprises an LED load 3, an MOS transistor 5 and a constant current control circuit 7, the LED load 3 is connected between a drain electrode 51 of the MOS transistor 5 and a positive electrode 71 of the constant current control circuit 7, a source electrode 53 of the MOS transistor 5 is grounded and connected to a negative electrode 73 of the constant current control circuit 7, a gate electrode 55 of the MOS transistor 5 is also connected to the negative electrode 73 of the constant current control circuit 7 through a capacitor 9, and the source electrode 53 of the MOS transistor 5 is grounded through a resistor 8.

Figure 2:
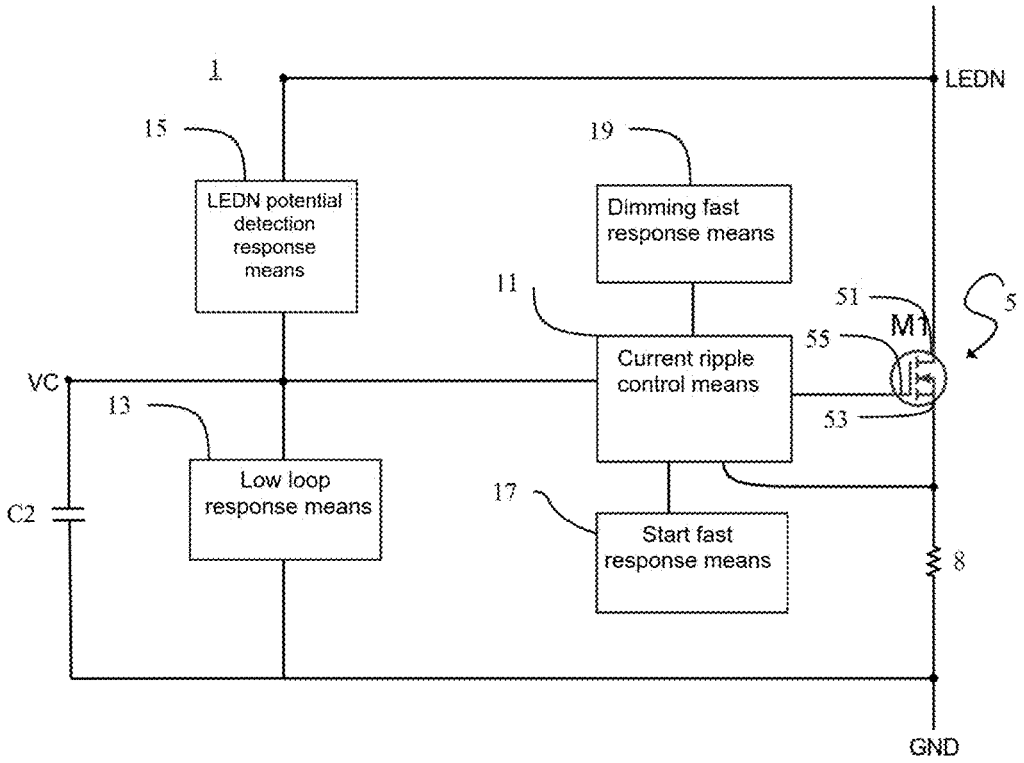
FIG. 2 shows a structural diagram of functional means of a preferred embodiment of a driver circuit used for eliminating current ripple of a light emitting diode (LED) driver system according to the invention.

FIG. 2 shows a structural diagram of functional means of a preferred embodiment of a driver circuit used for eliminating current ripple of a light emitting diode (LED) driver system according to the invention. The figure shows that the driver circuit 1 according to the invention comprises a current ripple control means 11, a low loop response means 13, an LEDN potential detection response means 15, a start fast response means 17 and a dimming fast response means 19.

The current ripple control means 11 is connected with the gate electrode 55 of the MOS transistor 5, the source electrode 53 of the MOS transistor 5, the low loop response means 13, the LEDN potential detection response means 15, the start fast response means 17 and the dimming fast response means 19 respectively, and connected to an end (VC end as shown in FIG. 2). In other words, after the driver circuit 1 according to the invention is constructed on the LED driver system, the current ripple control means 11 is connected between the capacitor 9 and the gate electrode 55 of the MOS transistor 5. The current ripple control means 11 according to the invention is used for adjusting a gate-source voltage (Vgs) of the MOS transistor 5, thus further adjusting a conduction impedance of the MOS transistor 5 to convert current ripple output by a preceding-stage constant current to voltage ripple at two ends of the drain-source 51 of the MOS transistor 5.

The low loop response means 13 is respectively connected to the current ripple control means 11, the LEDN potential detection response means 15 and the VC end of the capacitor 9, and is grounded. The low loop response means 13 according to the invention is used for setting a system response period at least higher than fluctuation period of an effective value of voltage of the mains supply while the low loop response means is in normal operation, so as to eliminate breathing type sway of the LED load 3 (i.e. LED lamp) at a very low frequency due to a low TRIAC dimming current resulting from fluctuating effective value of input AC power supply.

The LEDN potential detection response means 15 is connected with the current ripple control means 11, the low loop response means 13, the VC end of the capacitor 9, the drain electrode 51 of the MOS transistor 5, and the end of the LED load 3 (that is, the LEDN end shown in the figure) far from the positive electrode 71 of the constant current control circuit 7. The LEDN potential detection response means 15 according to the invention is used for controlling magnitude of current flowing to the VC end according to potential of the LEDN end.

The start fast response means 17 is connected to the current ripple control means 11. The start fast response means 17 according to the invention is used for increasing the current flowing to the VC end while the preceding-stage output current is increasing (i.e. when the system is started or a TRIAC dimming conduction angle increases) to increase response speed of the system.

The dimming fast response means 19 is connected to the current ripple control means 11. The dimming fast response means 19 according to the invention is used for enabling a leakage path from the VC end to the ground (GND) when the TRIAC dimming conduction angle decreases to quickly decrease the gate-source voltage (Vgs) of the MOS transistor 5 to adapt to low current flow.

In the prior art, as the LED driver system normally requires a high power factor and a large electrolytic condenser is not present behind a bridge rectifier, the sinusoidal wave of an AC network often causes the voltage fluctuation of the LED positive electrode. The LED current ripple elimination circuit according to the invention adjusts the gate voltage of the power MOS transistor 5 by detecting the voltage of the LED negative electrode, thus further affecting the conduction impedance of the power MOS transistor 5 operating in the saturation region. The change in the conduction impedance of the MOS transistor 5 results in a change to the drain-source voltage of the MOS transistor 5. The system offsets the voltage fluctuation at both ends of the LED lamp (LED load 3) caused by the voltage fluctuation of the LED positive electrode with the change in the drain-source voltage of the MOS transistor 5, so that the voltage at both ends of the LED lamp is fixed and constant current flows through the LED lamp to eliminate stroboflash of the LED lamp.

Figure 4:
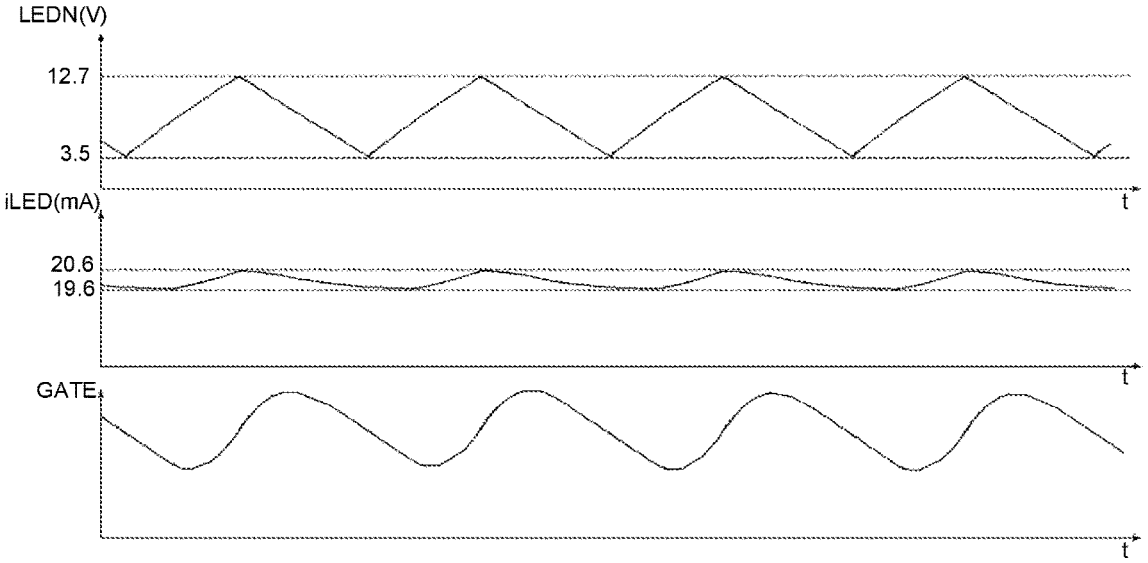
FIG. 4 shows a schematic diagram of changes in output current ripple and gate voltage of the power high voltage MOS transistor.

FIG. 4 shows the relationship between the current ripple and the gate voltage fluctuation in an embodiment of the invention. The channel modulation effect of the power high voltage MOS transistor 5 almost has no influence, so the output current (iLED) ripple depends on the gate voltage (GATE) fluctuation of the power high voltage MOS transistor 5. Therefore, the loop response speed of the output current ripple elimination system during steady operation is capable of being slowed down by reducing the charging and discharging current of the capacitor on the gate electrode, so as to effectively suppress the gate voltage fluctuation of the power high voltage MOS transistor 5 and further significantly eliminate the output current ripple.

Figure 5:
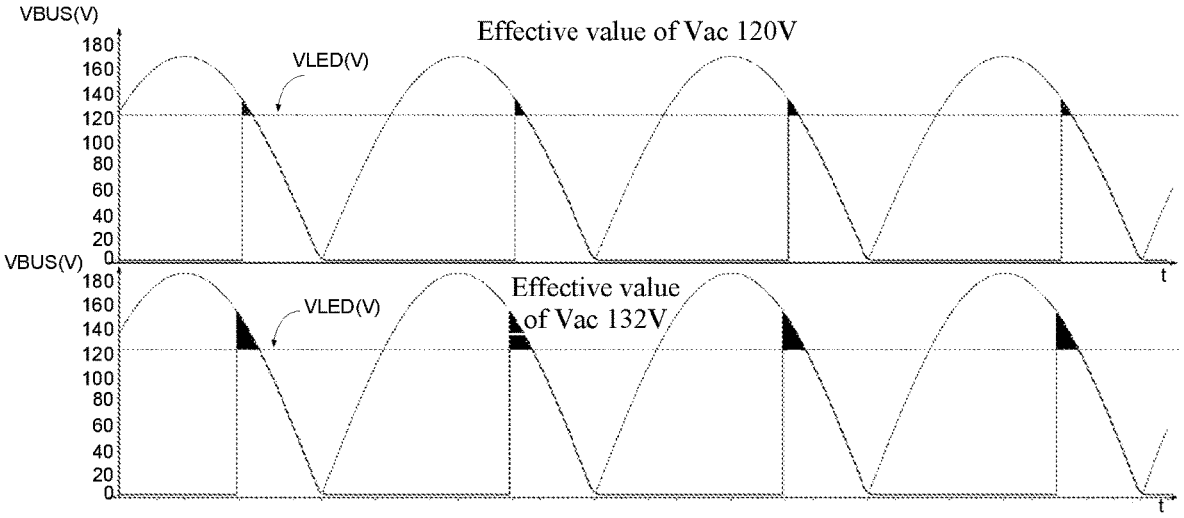
FIG. 5 shows a schematic diagram of changes in transmitted energy resulting from fluctuating effective value of Vac due to a low TRIAC dimming current.

As shown in FIG. 5, when a TRIAC dimmer is chopping wave at a small conduction angle, a significant low-frequency breathing type sway in the brightness of the output LED lamp is observed due to large difference in the energy transmitted to the load between power frequency periods of the mains supply (Vac). As the period of fluctuation of the effective value of the mains voltage (VBUS) is usually within 10 seconds, the design loop bandwidth period of the system should be significantly longer than 10 seconds to effectively suppress the fluctuation of the output current value of the LED lamp caused by the fluctuation of the effective value of the mains voltage, thus eliminating the low-frequency breathing type sway of the LED lamp due to a low TRIAC dimming current.

Figure 3:
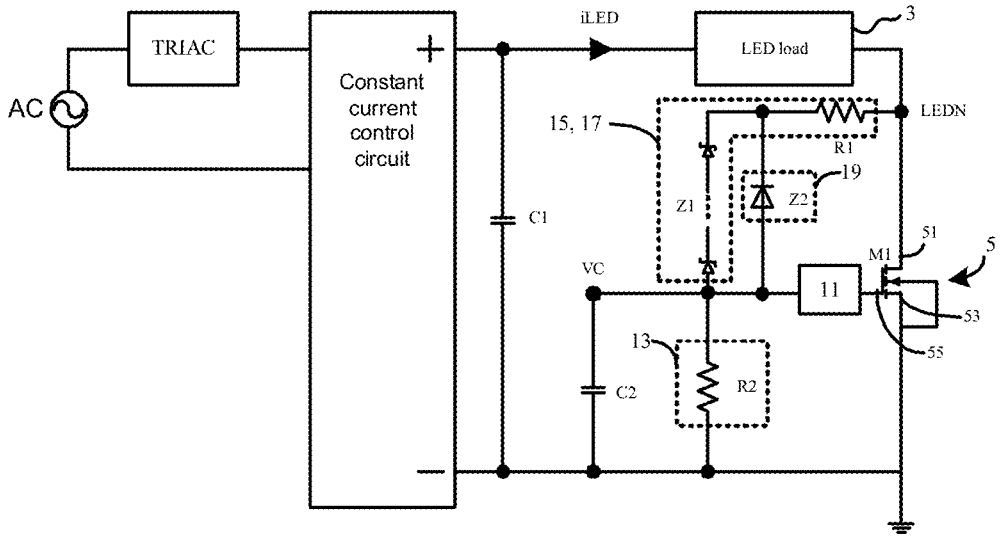
FIG. 3 shows a schematic diagram of an embodiment of the LEDN potential detection response means according to the invention.
Figure 8:
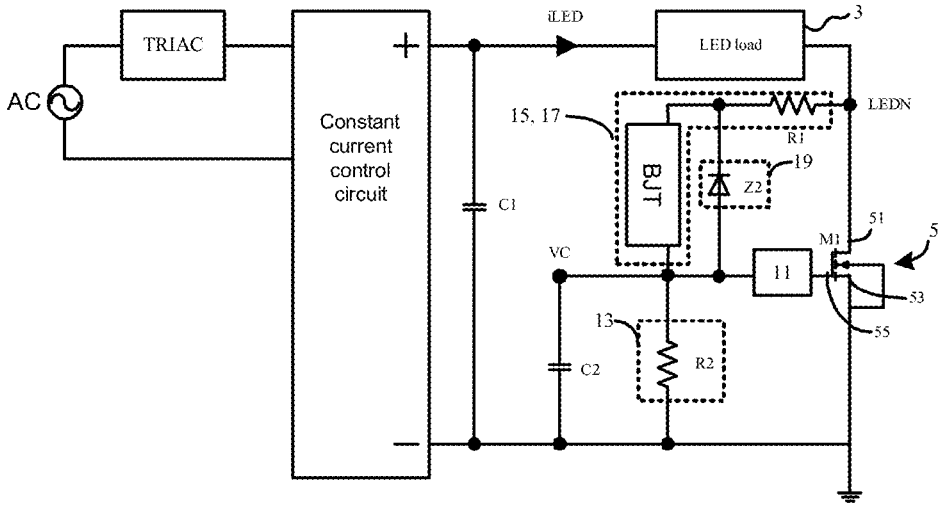
FIG. 8 shows another embodiment of the LEDN potential detection response means according to the invention.

FIG. 3 shows an embodiment of the circuit of the LEDN potential detection response means 15 according to the invention. As shown in the figure, multiple zener voltage stabilizing diodes (Z1) and a current limiting resistor R1 are connected in series between the gate electrode 55 and the drain electrode 51 of the power high voltage MOS transistor 5. The number of the zener voltage stabilizing diodes (Z1) can be adjusted according to requirements for output current of different systems and volume of the energy storage capacitor C1. Alternatively, the zener voltage stabilizing diodes (Z1) can also be bipolar junction transistors (BJT), as shown in FIG. 8.

Figure 9:
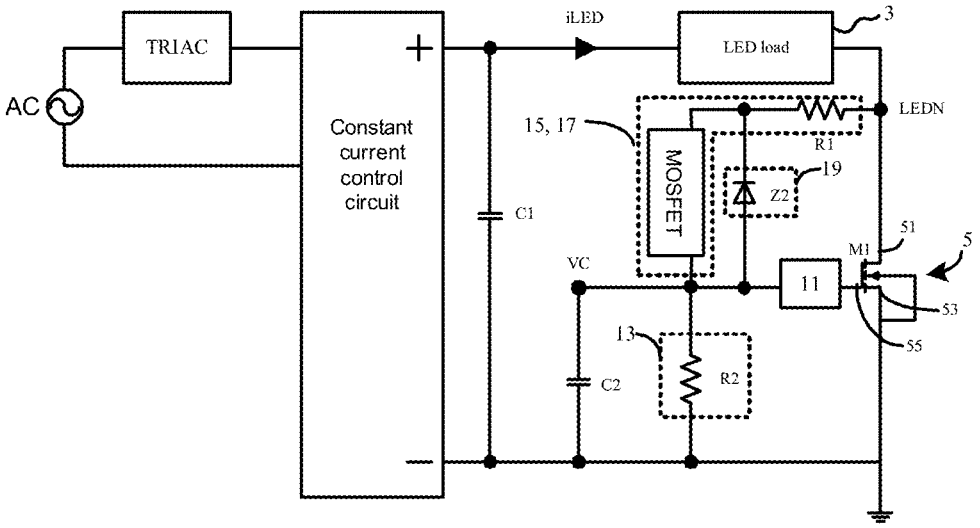
FIG. 9 shows another embodiment of the LEDN potential detection response means according to the invention.

Alternatively, the zener voltage stabilizing diodes (Z1) can also be metal oxide semiconductor field effect transistors (MOSFET) with a gate and a source shorted together, as shown in FIG. 9.

Figure 6:
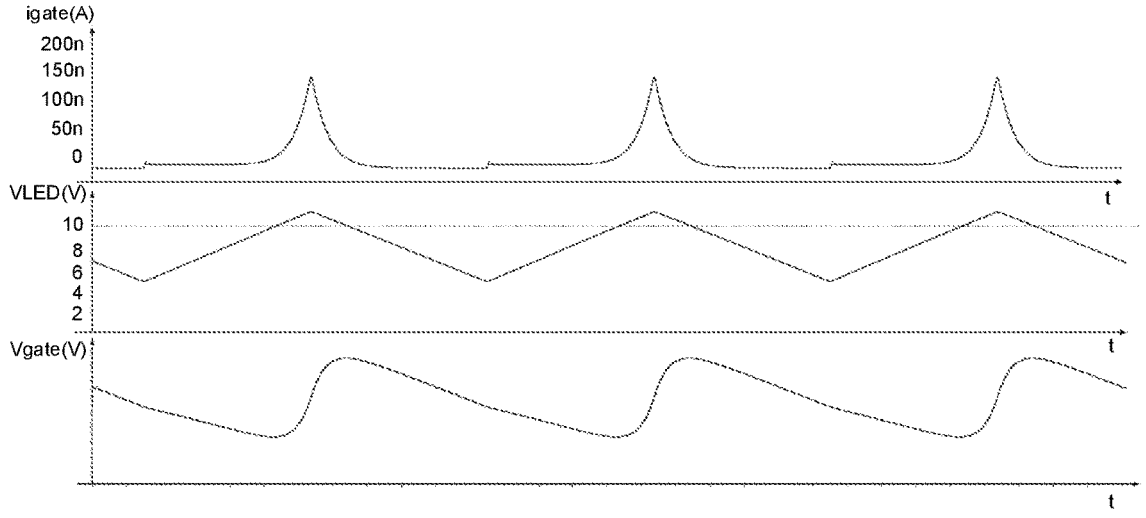
FIG. 6 shows a schematic diagram of changes in charge-discharge range of the gate electrode of the MOS transistor.

The resistance (R1) between the gate electrode 55 and the source electrode 53 of the power high voltage MOS transistor 5 is set to be above 100 MΩ. Thus, a gate capacitor 9 of the MOS transistor 5 discharges at a current of 10 nA to GND through 100 MΩ resistor in each power frequency period during the normal operation of the circuit. Meanwhile, FIG. 6 shows that the current flows into the gate capacitor 9 only if $V_{ds}$ is higher than the sum of $V_{gs}$ and $V_z$ in the charge range of the gate capacitor 9 of the MOS transistor 5) during the entire power frequency period. When current flows into the gate capacitor 9, the gate potential increases and the $V_{ds}$ decreases.

The $V_{ds}$ is the voltage between the drain electrode and the source electrode of the power high voltage MOS transistor 5, the $V_{gs}$ is the voltage between the gate electrode and the source electrode of the power high voltage MOS transistor 5, and the $V_z$ is the sum of the reverse on-state voltage of the multiple zener voltage stabilizing diodes (Z1), as shown in FIG. 3.

Therefore, with the method of the invention, the charge range of the gate capacitor 9 accounts for a small proportion of the entire power frequency period. A current limiting resistor is arranged between the drain electrode 51 of the power high voltage MOS transistor 5 and the negative electrode of the zener voltage stabilizing diodes (Z1). As a result, the gate capacitor 9 of the MOS transistor 5 is subject to low current charging during the entire power frequency period.

Therefore, the output current ripple elimination circuit according to the invention has a very low system loop response speed in a stable operating state, thus ensuring excellent output current ripple elimination function of the circuit and eliminating breathing type sway of the LED lamp at a very low frequency due to a low TRIAC dimming current.

In practical application of TRIAC dimming, the system is usually required to have a high response speed when the brightness of the LED lamp is controlled with the TRIAC dimmer. The process of adjusting the brightness of the LED lamp with the TRIAC dimmer comprises two cases: the output current decreases with the chopping conduction angle of the TRIAC dimmer, and the brightness of LED the lamp is dimmed; and the output current increases with the chopping conduction angle of the TRIAC dimmer, and the brightness of the LED lamp is increased. In the first case, the voltage $V_{ds}$ between the drain electrode and source electrode of the power high voltage MOS transistor increases rapidly, thus widening the charge range of the gate capacitor of the MOS transistor, increasing the charging current, and rapidly raising the voltage $V_{gs}$ between the gate electrode and the source electrode of the power high voltage MOS transistor.

Figure 10:
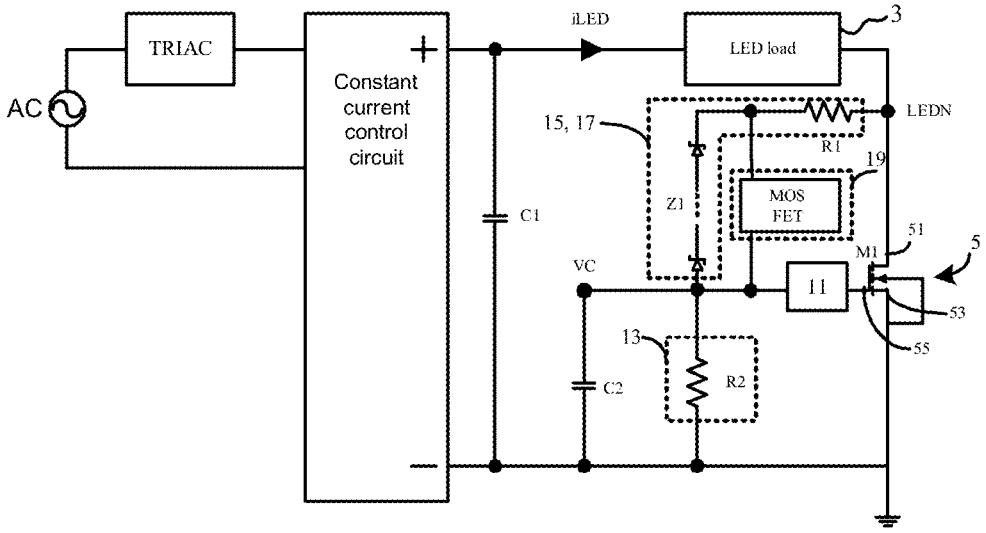
FIG. 10 shows another embodiment of the LEDN potential detection response means according to the invention.
Figure 11:
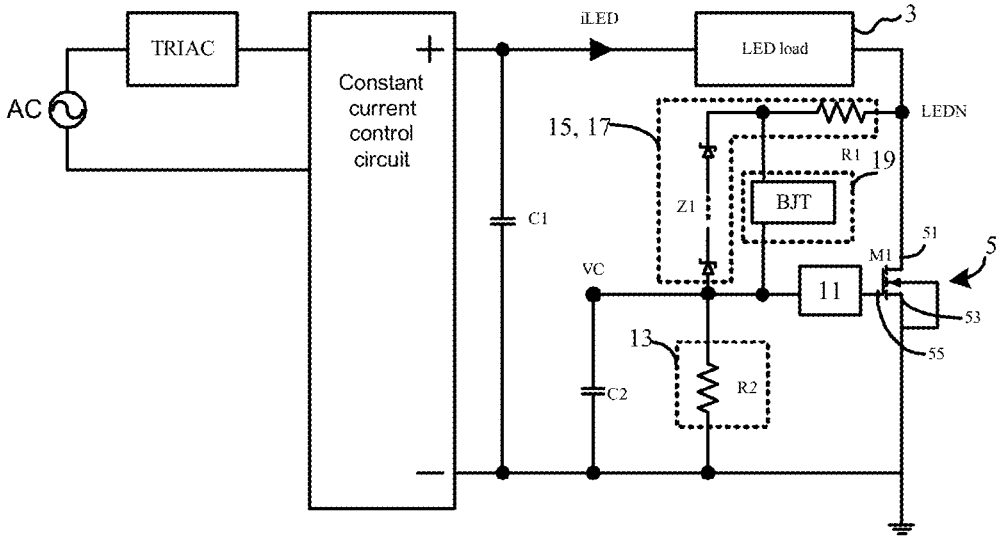
FIG. 11 shows another embodiment of the LEDN potential detection response means according to the invention.

In the second case, the current flowing through the LED lamp and the power high voltage MOS transistor decreases due to the decreased input power. As a response, the voltage $V_{gs}$ between the gate electrode and the source electrode of the power high voltage MOS transistor should decrease rapidly. However, the leakage path from the gate electrode to GND only passes through the 100 MΩ resistor and fails to meet the requirement of rapid decreasing response. Therefore, it is necessary to add a gate electrode to the GND rapid leakage path without affecting the very low system loop response when the circuit works stably. FIG. 3 shows an embodiment of the LEDN potential detection response means according to the invention, wherein the zener voltage stabilizing diodes are parallel connected with a high voltage diode, a high voltage MOSFET with a gate and a source shorted together (shown in FIG. 10) or a high voltage bipolar junction transistor (BJT) (shown in FIG. 11) between the gate electrode and the current limiting resistor R1.

Figure 7:
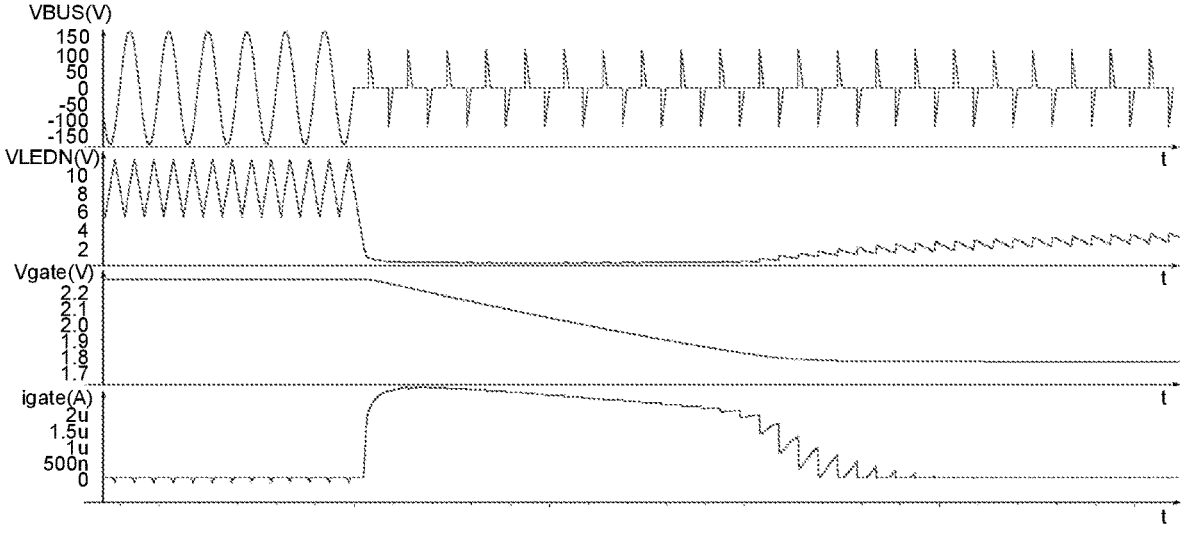
FIG. 7 shows a schematic diagram of changes in fast response of the gate electrode of the MOS transistor when the TRIAC dimming conduction angle decreases.

As shown in FIG. 7, when the current ripple elimination circuit works normally, the drain voltage is higher than the gate voltage of the MOS transistor, and no current flows through the high voltage diode. In the second case of TRIAC dimming application, the voltage $V_{ds}$ between the drain electrode and the source electrode of the power high voltage MOS transistor decreases rapidly due to the decrease of current flowing through the power high voltage MOS transistor. When the $V_{ds}$ is lower than the $V_{gs}$, the gate capacitor of the power high voltage MOS transistor quickly discharges from the high voltage diodes to GND through the power high voltage MOS transistor. Therefore, the voltage $V_{gs}$ between the gate electrode and the source electrode of the power high voltage MOS transistor can respond by decreasing rapidly in the second case of TRIAC dimming application.

Compared with the prior art, FIG. 3 shows an embodiment of the low loop response means 13 of the invention, wherein a group of voltage stabilizing diodes (Z1) comprising one or multiple zener diodes is used to connect the second end of the resistor R1 and the gate electrode 55 of the power transistor 5, and the path between the gate electrode of the power high voltage MOS transistor and the GND is at a low current. The advantages of the invention are as follows:

1. The loop response speed of the LED current ripple elimination circuit is very low during the normal operation of LED current ripple elimination circuit, allowing a very small gate voltage fluctuation of the power high voltage MOS transistor and reducing the output current ripple flowing through the LED lamp to less than 1%; and
2. The low loop response speed of the circuit effectively suppresses the breathing type sway of the LED lamp due to a low TRIAC dimming current resulting from fluctuating effective value of the input AC power supply. The invention is applicable to most of the commercially available TRIAC dimmers, and the PST index of an LED light source is less than 0.5 when the TRIAC dimming depth is higher than 1%.

According to the preferred embodiments, those of ordinary skill in the art can further understand the features and spirit of the invention. It should be understood that the above mentioned embodiments are only illustration for the principles and functions of the invention instead of limitation thereof. Therefore, any modifications and changes to the embodiments should not depart from spirit of the invention, and the protection scope of the invention should be defined by the claims.

The invention claimed is:

1. A drive circuit for eliminating ripple current of an LED driver system, which comprises an LED load, an MOS transistor and a constant current control circuit, wherein the LED load is connected between a drain electrode of the MOS transistor and the constant current control circuit; a source electrode of the MOS transistor is grounded and connected to the constant current control circuit; one end of a capacitor is connected with the constant current control circuit; and the source electrode of the MOS transistor is grounded through a resistor, and the drive circuit comprises:

a ripple current control means, connected with a gate electrode of the MOS transistor, the source electrode of the MOS transistor, a low loop response means, an LEDN potential detection response means, a start fast response means and a dimming fast response means, and connected to another end of the capacitor, and used for adjusting a gate-source voltage of the MOS transistor to adjust a conduction impedance of the MOS transistor, thereby to adjust a drain-source voltage of the MOS transistor; wherein the low loop response means is connected with the LEDN potential detection response means and the another end of the capacitor and grounded;

the LEDN potential detection response means is connected with the another end of the capacitor, the drain electrode of the MOS transistor and one end of the LED load, and used for controlling magnitude of current flowing to the another end of the capacitor according to potential of the LEDN end;

the start fast response means is used for increasing the current flowing to the another end of the capacitor while an output current of the preceding-stage is increasing to increase response speed of the system; and the dimming fast response means is used for enabling a leakage path from the another end of the capacitor to ground when a TRIAC dimming conduction angle decreases to quickly decrease the gate-source voltage of the MOS transistor to adapt to low current flow.

2. The drive circuit for eliminating ripple current of the LED driver system according to claim 1, wherein a system response period of the low lop response module means is set to be at least higher than a fluctuation period of an effective value of voltage of a mains supply.

3. The drive circuit for eliminating ripple current of the LED driver system according to claim 1, wherein the LEDN potential detection response means is made of at least one zener voltage stabilizing diode and a current limiting resistor connected in series between the gate electrode and the drain electrode of the MOS transistor.

4. The drive circuit for eliminating ripple current of the LED driver system according to claim 3, wherein the dimming fast response means is a high voltage diode connected in parallel between two ends of the at lest one zener voltage stabilizing diode of the LEDN potential detection response means.

5. The drive circuit for eliminating ripple current of the LED driver system according to claim 3, wherein the dimming fast response means is a high voltage MOSFET with gate-source short which is connected in parallel between the two ends of the at least one zener voltage stabilizing diode of the LEDN potential detection response means.

6. The drive circuit for eliminating ripple current of the LED driver system according to claim 3, wherein the dimming fast response means is a high voltage bipolar junction transistor (BJT) connected in parallel between two ends of the at least one zener voltage stabilizing diode of the LEDN potential detection response means.

7. The drive circuit for eliminating ripple current of the LED driver system according to claim 1, wherein the LEDN potential detection response means is made of at least one bipolar junction transistor (BJT) and a current limiting resistor connected in series.

8. The drive circuit for eliminating ripple current of the LED driver system according to claim 1, wherein the LEDN potential detection response means is made of at least one MOSFET with gate-source short and a current limiting resistor connected in series.

9. The drive circuit for eliminating ripple current of the LED driver system according to claim 1, wherein the low loop response means is made of a resistor with a resistance greater than 1 M ohm connected between the gate electrode of the MOS transistor and the GND.

* * * * *